US007914328B2

(12) United States Patent
Tanaka et al.

(10) Patent No.: US 7,914,328 B2
(45) Date of Patent: Mar. 29, 2011

(54) CONNECTOR

(75) Inventors: Yukitaka Tanaka, Tokyo (JP); Chikara Kawamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/774,914

(22) Filed: May 6, 2010

(65) Prior Publication Data

US 2010/0304610 A1 Dec. 2, 2010

(30) Foreign Application Priority Data

May 29, 2009 (JP) ..... 2009-130946

(51) Int. Cl.
*H01R 13/648* (2006.01)

(52) U.S. Cl. ..... 439/607.08; 439/607.19; 439/607.54; 439/939; 439/607.17

(58) Field of Classification Search ..... 439/607.08, 439/607.17, 607.19, 607.54, 939
See application file for complete search history.

(56) References Cited

U.S. PATENT DOCUMENTS

| | | | | |
|---|---|---|---|---|
| 5,256,074 | A * | 10/1993 | Tan et al. | 439/108 |
| 5,474,472 | A * | 12/1995 | Niwa et al. | 439/607.08 |
| 5,975,957 | A * | 11/1999 | Noda et al. | 439/607.19 |
| 6,364,707 | B1 * | 4/2002 | Wang | 439/607.53 |
| 6,447,316 | B1 * | 9/2002 | Jon et al. | 439/181 |
| 7,052,322 | B2 * | 5/2006 | Hu et al. | 439/607.25 |
| 7,621,780 | B2 * | 11/2009 | Magnusson | 439/607.23 |
| 7,690,947 | B2 * | 4/2010 | Gu et al. | 439/607.23 |

FOREIGN PATENT DOCUMENTS

JP 3298920 B2 4/2002

* cited by examiner

*Primary Examiner* — James Harvey
(74) *Attorney, Agent, or Firm* — Holtz, Holtz, Goodman & Chick, PC

(57) ABSTRACT

A shielded connector which makes a shell unnecessary while ensuring a shielding function. A housing holds a housing plurality of contacts each including a contact portion brought into contact with an associated one of contact portions of a plurality of mating contacts. The connector is provided with a shield member including a shield plate body which partitions the contact portions of the contacts into two groups, a first spring portion which is brought into contact with an inner wall surface of a shell of a mating connector, and a second spring portion which is brought into contact with the inner wall surface of the shell.

8 Claims, 20 Drawing Sheets

CONNECTOR

BACKGROUND OF THE INVENTION

1. Field of the Invention

This invention relates to a connector, and more particularly to a so-called shielded connector.

2. Description of the Related Art

Conventionally, there has been proposed a shielded connector which is comprised of a housing, a plurality of contacts held by the housing, and a metal shell surrounding contact portions of the contacts (see Japanese Patent No. 3298920).

The contact portions of the contacts are arranged in four rows, and a metal plate is disposed between the upper two rows and the lower two rows. Bent portions of opposite ends of the metal plate are in contact with an inner wall surface of the metal shell, whereby electrical conductivity between the metal plate and the metal shell is ensured, and hence this prevents crosstalk between the contacts in the upper two rows and the contacts in the lower two rows.

The metal plate is held by the housing by press-fitting, and the bent portions of the metal plate is not fixed by soldering but is merely in contact with the inner wall surface of the metal shell.

Therefore, if the dimensions of the metal plate and the metal shell are set such that the bent portions of the metal plate are positively brought into contact with the inner wall surface of the metal shell, the metal plate or the metal shell is deformed, which may make it difficult to fit the metal shell and a metal shell of a mating connector to each other. Further, this may also cause the metal plate or the metal shell to be damaged depending on the strength of the metal plate or the metal shell.

SUMMARY OF THE INVENTION

The present invention has been made in view of these circumstances, and an object thereof is to provide a connector which makes a shell unnecessary while ensuring a shielding function.

To attain the above object, the present invention provides a connector that is fitted to a mating connector including a plurality of mating contacts held by a mating housing, and a shell mounted on the mating housing such that the shell surrounds mating contact portions of the plurality of mating contacts, comprising a housing, a plurality of contacts that are held by the housing, and each include a contact portion which is brought into contact with an associated one of the mating contact portions of the plurality of mating contacts, and a shield member that is mounted on the housing, and includes a shield plate body which partitions the contact portions of the plurality of contacts into a plurality of groups, and a spring portion formed on the shield plate body, which is brought into contact with an inner wall surface of the shell.

With the arrangement of the connector according to the present invention, the contact portions of the plurality of contacts are partitioned into the plurality of groups by the shield plate body, and the spring portion formed on the shield plate body is brought into contact with the inner wall surface of the shell of the mating connector to thereby cause the spring force of the spring portion to act on the inner wall surface of the shell, and hence even if the accuracy of the dimensions of the shell of the mating connector and the shield member is not high, it is possible to ensure the stable contact state between the shell and the shield member, which makes it possible to cause the shell of the mating connector to serve as the shell of the connector itself.

Preferably, the inner wall surface of the shell includes two surfaces opposed to each other, and the spring portion comprises a first spring portion which is brought into contact with one of the two surfaces of the inner wall surface of the shell, and a second spring portion which is brought into contact with the other of the two surfaces of the inner wall surface of the shell.

Preferably, the shield plate body includes a connection portion provided for connection of cables thereto.

More preferably, the shield plate body includes a plate portion formed to be close to one of the two surfaces, and the connection portion is in the form of a plate which is close to the other of the two surfaces.

Further preferably, the shield plate body, the first spring portion, the second spring portion, the connection portion, and the plate portion are formed by blanking and bending a metal plate.

According to this invention, a shell of the connector can be made unnecessary while ensuring the shielding function.

The above and other objects, features and advantages of the present invention will become more apparent from the following detailed description taken in conjunction with the accompanying drawings.

DETAILED DESCRIPTION OF THE PREFERRED EMBODIMENTS

Figure 1:
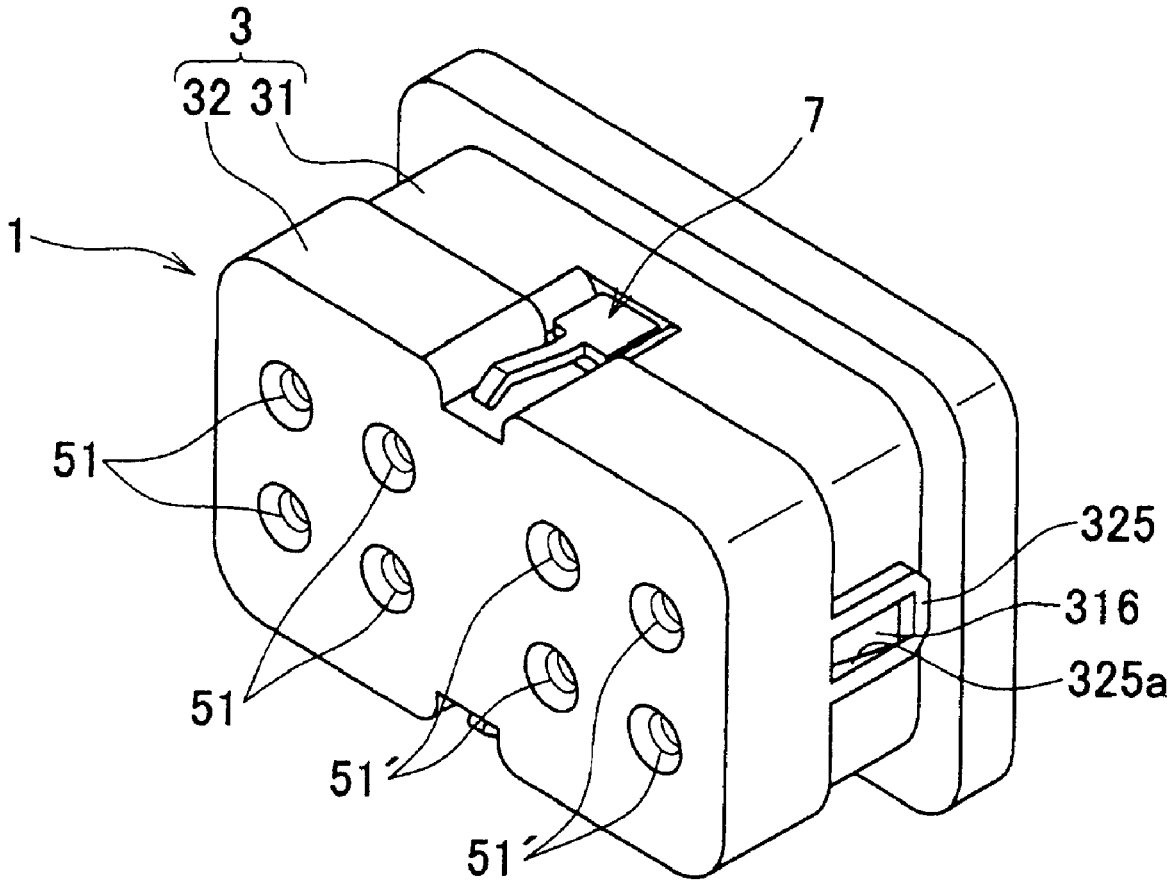
FIG. 1 is a perspective view of a connector according to an embodiment of the present invention.
Figure 2:
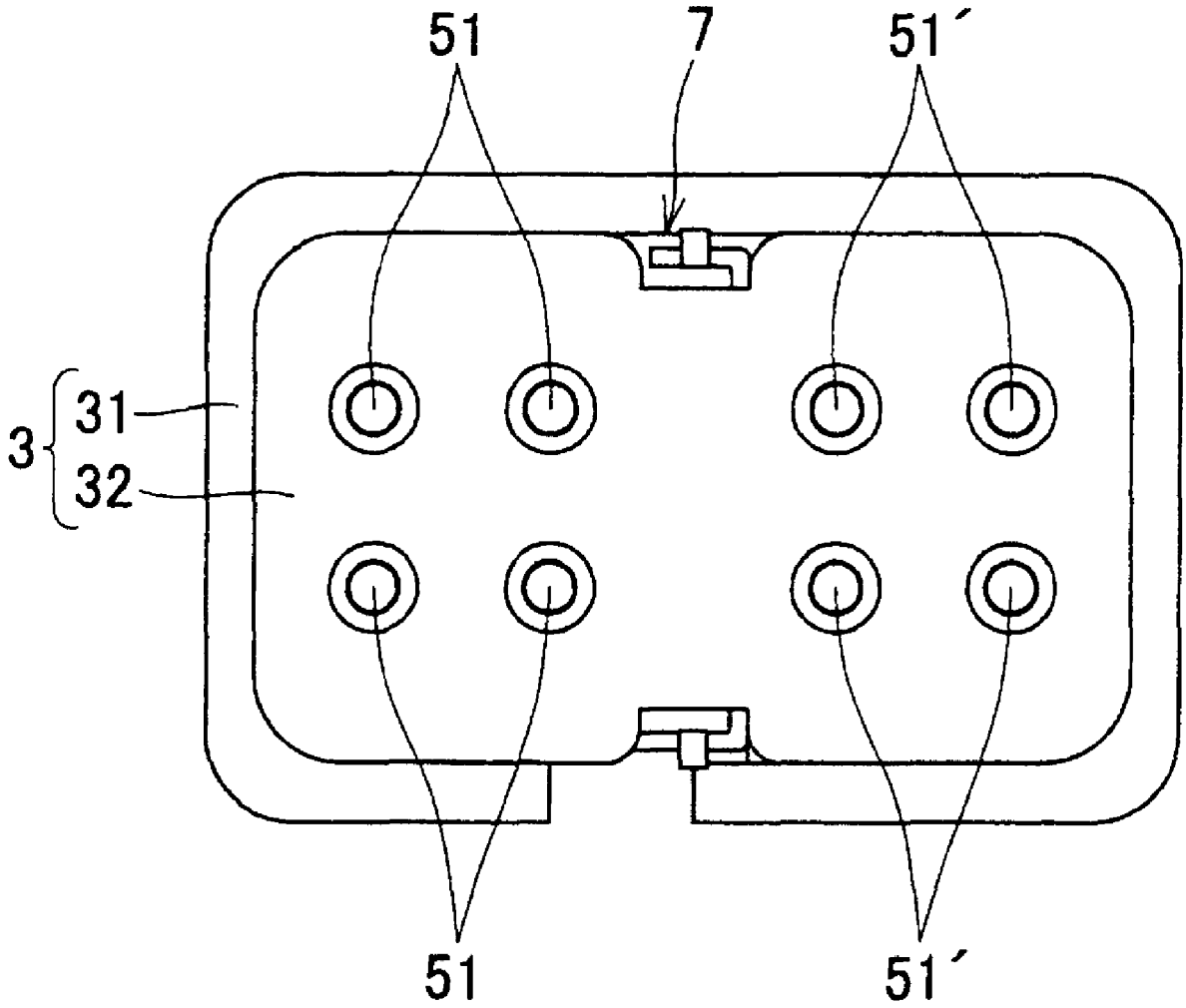
FIG. 2 is a front view of the connector shown in FIG. 1.
Figure 3:
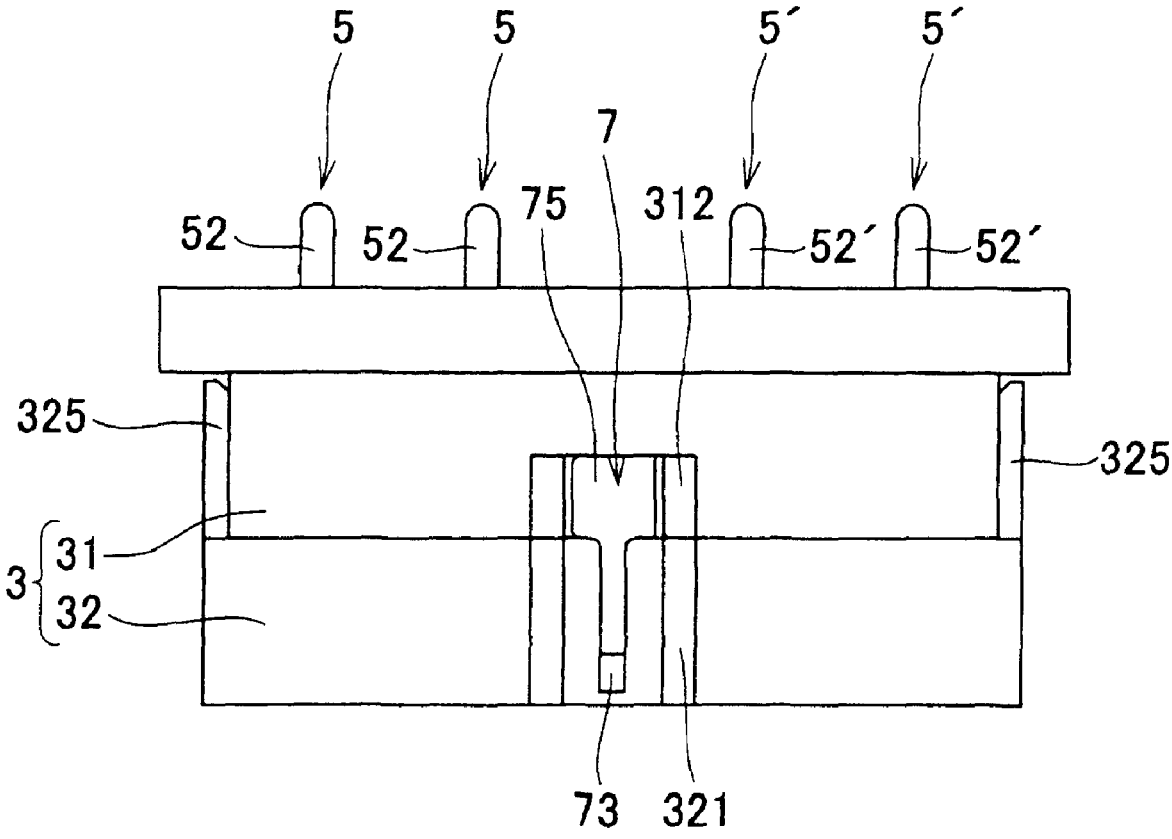
FIG. 3 is a plan view of the connector shown in FIG. 1.
Figure 4:
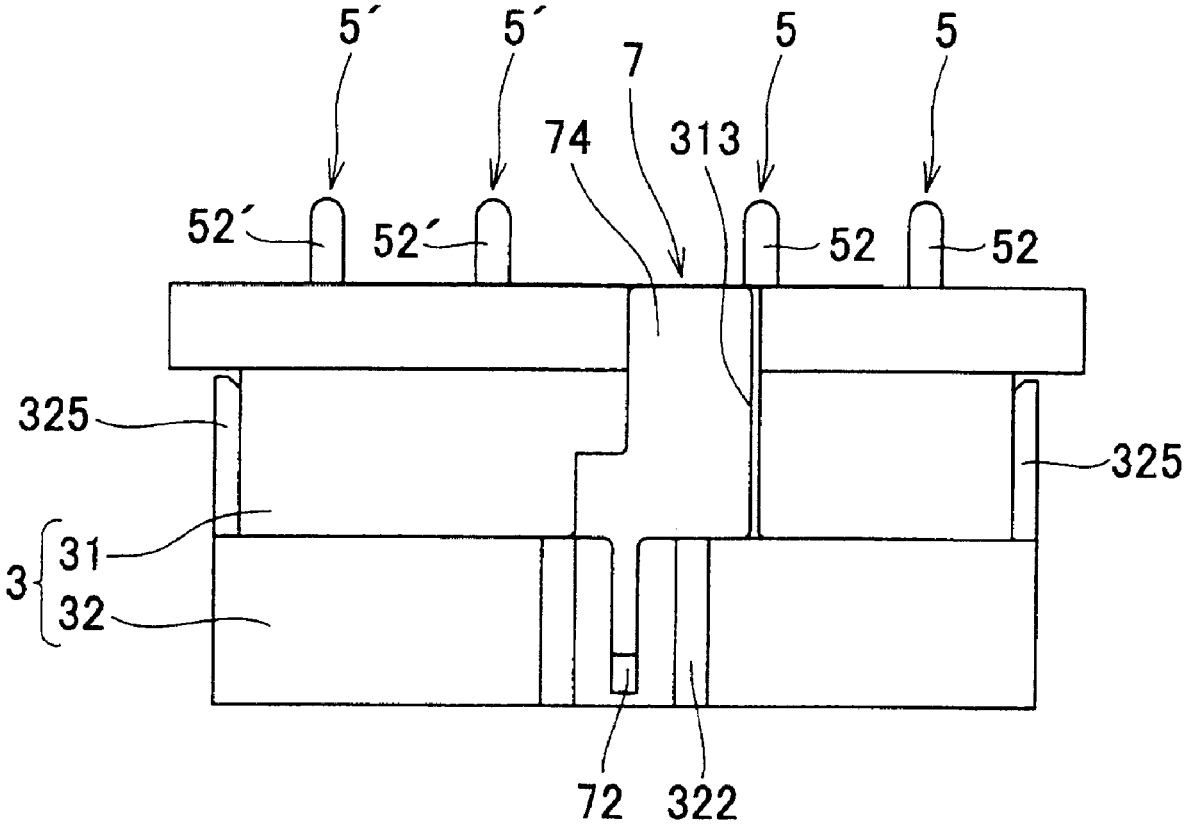
FIG. 4 is a bottom view of the connector shown in FIG. 1.

The present invention will now be described in detail with reference to the drawings showing preferred embodiments thereof.

Referring to FIGS. 1, 2, 3 and 4, a connector 1 is comprised of a housing 3, a plurality of contacts 5 and 5', and a shield member 7. The connector 1 is fitted to a mating connector 21 (see FIG. 15).

As shown in FIG. 1, the housing 3 is comprised of a rear housing 31 and a front housing 32.

Figure 5:
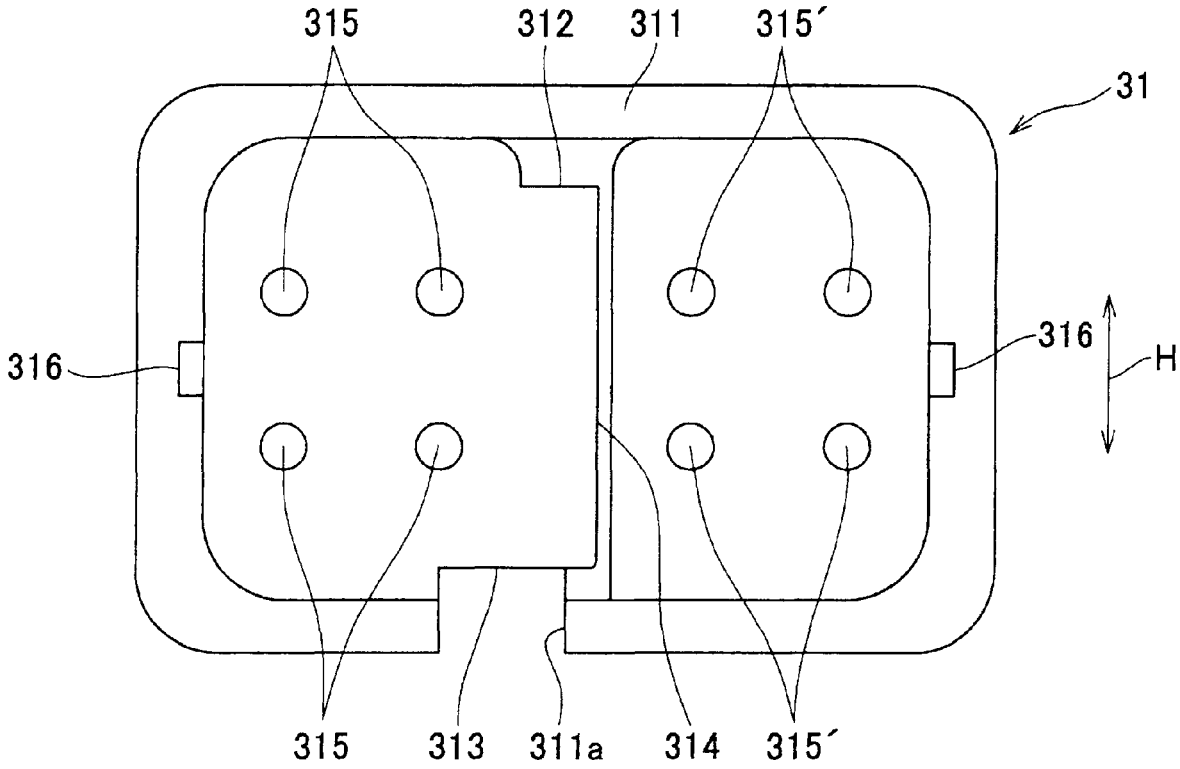
FIG. 5 is a front view of a rear housing of the connector shown in FIG. 1.
Figure 6:
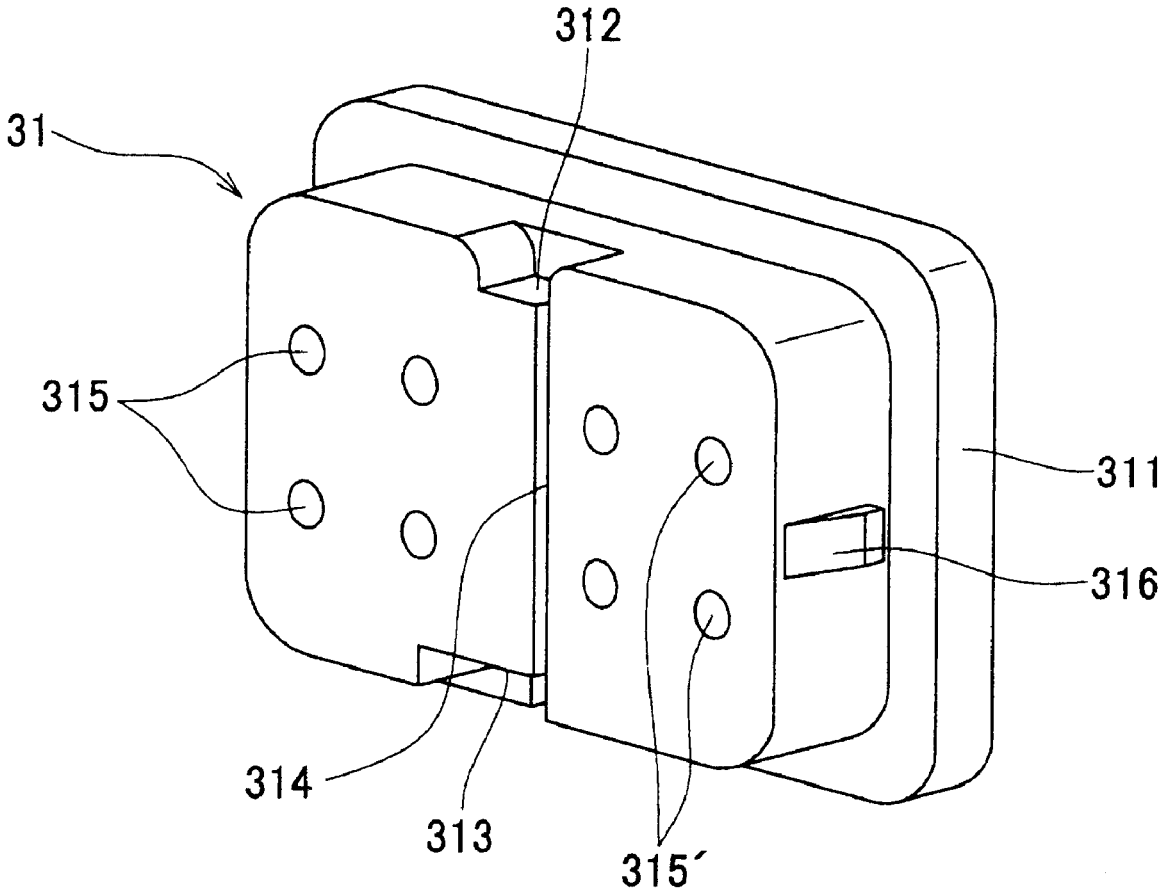
FIG. 6 is a perspective view of the rear housing shown in FIG. 5 as taken obliquely from the front.
Figure 7:
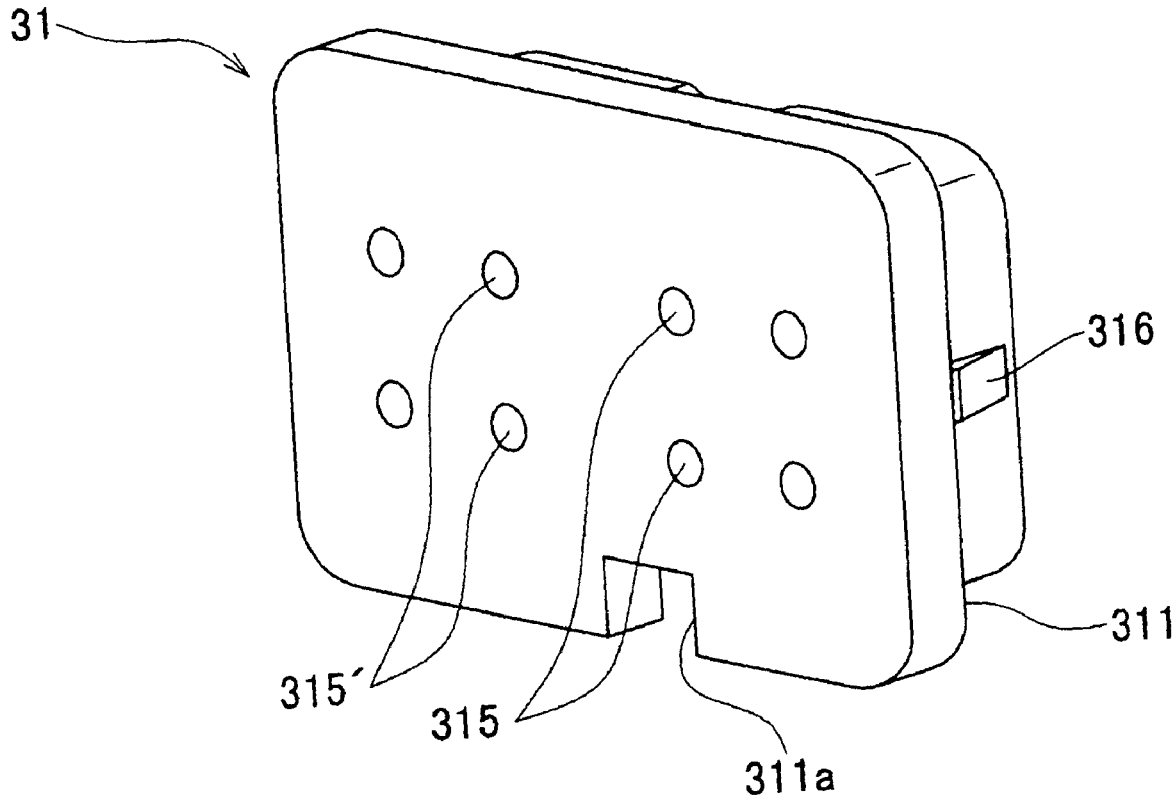
FIG. 7 is a perspective view of the rear housing shown in FIG. 5 as taken obliquely from the rear.

Referring to FIGS. 5, 6, and 7, the rear housing 31 is substantially plate-shaped, and includes a flange portion 311. The flange portion 311 is formed with a cutout 311*a*. The rear housing 31 has an upper surface formed with a recess 312, and a lower surface formed with a recess 313. The recess 313 is communicated with the cutout 311*a*. A front surface (see FIG. 5) of the rear housing 31 has a central part thereof formed with a groove 314. The groove 314 extends in the height direction H of the rear housing 31. One end of the groove 314 is communicated with the recess 312, and the other end of the groove 314 is communicated with the recess 313. As shown in FIG. 5, four contact holding holes 315 are formed in a left part of the rear housing 31 as viewed from the front. Four contact holding holes 315' are formed in a right part of the rear housing 31 as viewed from the front. The rear housing 31 has opposite sides thereof formed with protrusions 316, respectively.

Figure 8:
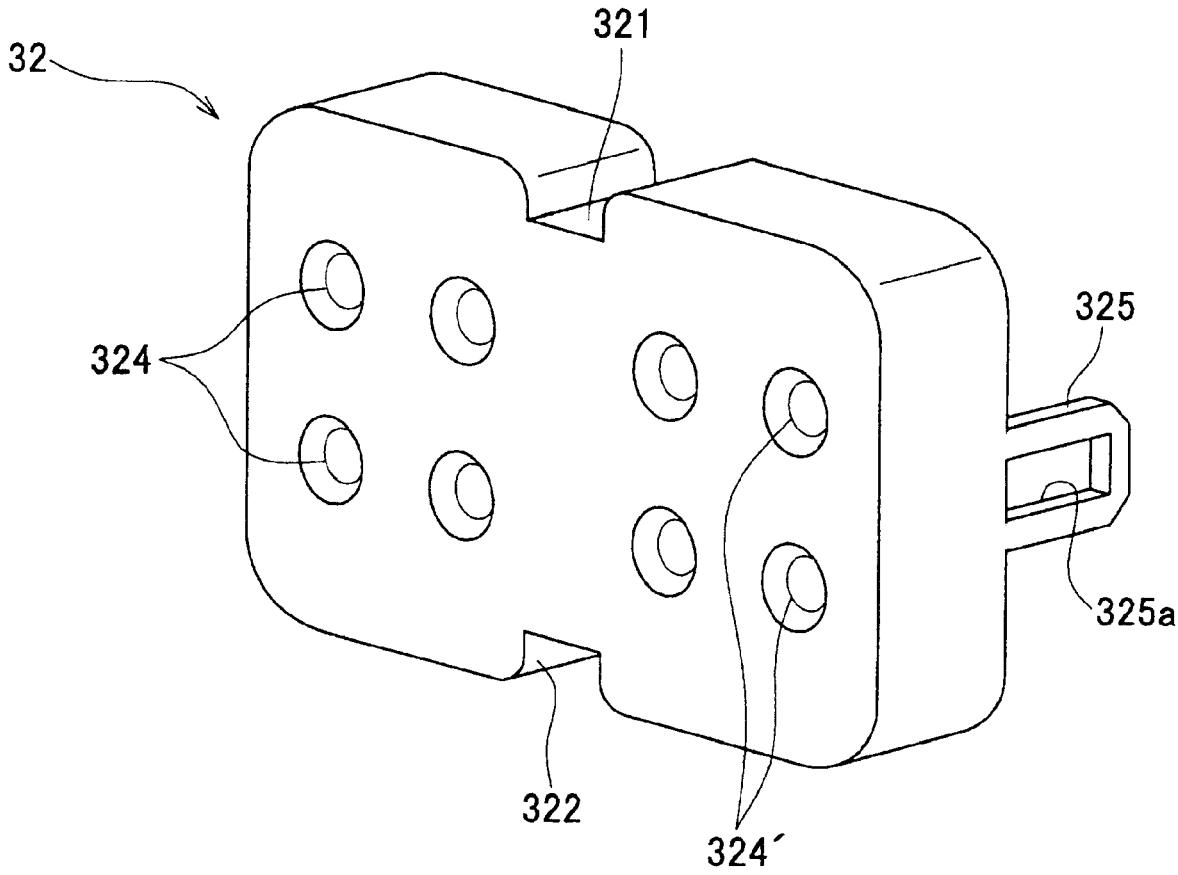
FIG. 8 is a perspective view of a front housing of the connector shown in FIG. 1 as taken obliquely from the front.
Figure 9:
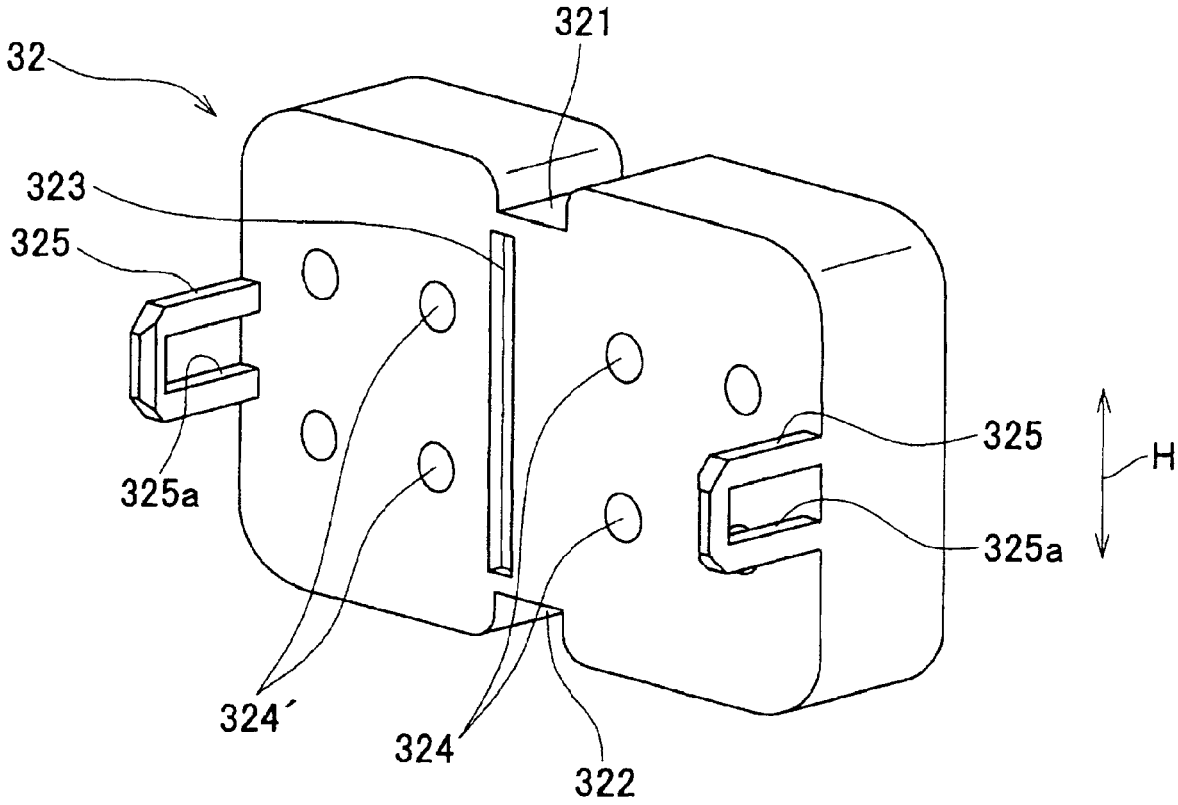
FIG. 9 is a perspective view of the front housing of the connector shown in FIG. 1 as taken obliquely from the rear.
Figure 10:
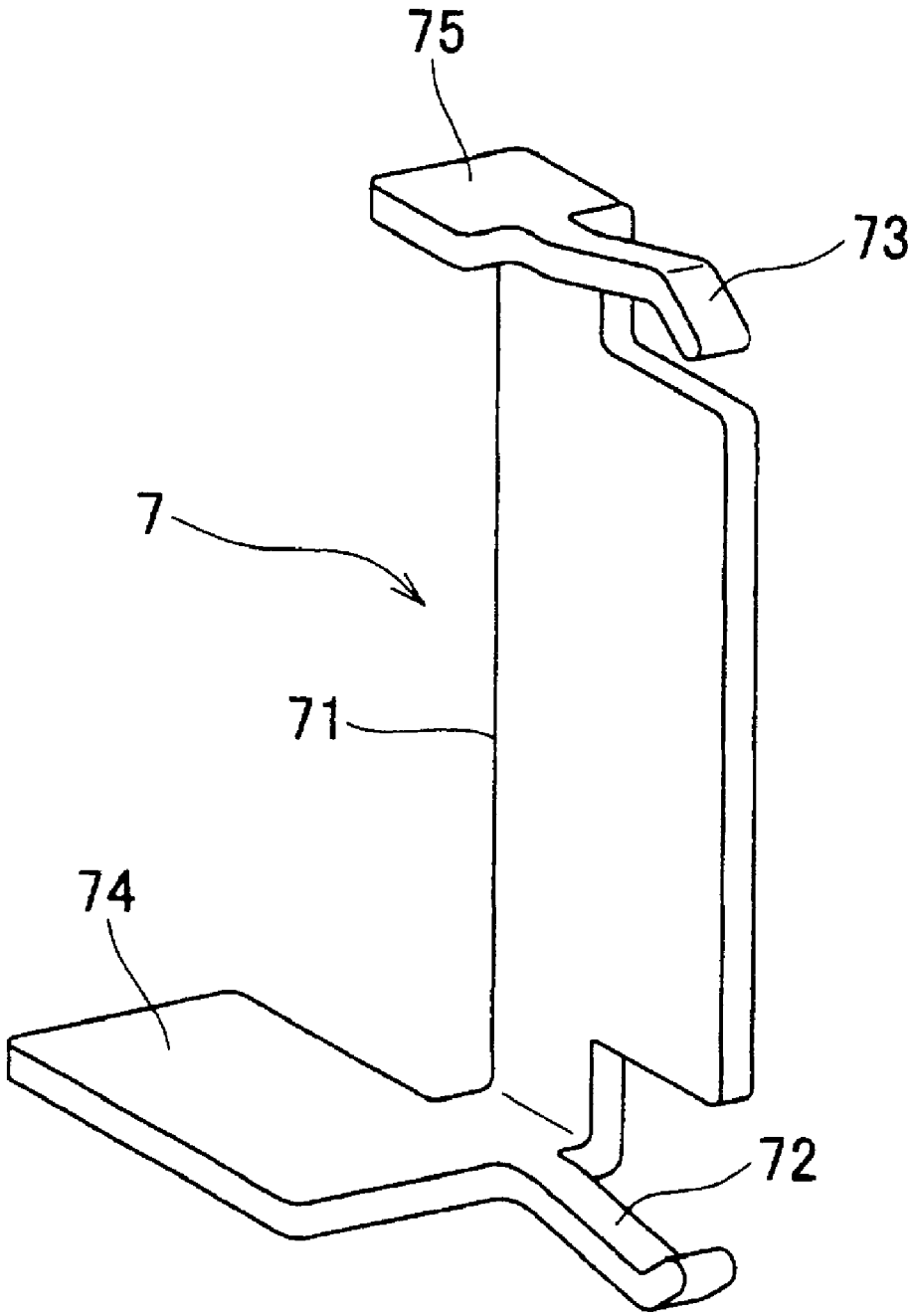
FIG. 10 is a perspective view of a shield member of the connector shown in FIG. 1.
Figure 11:
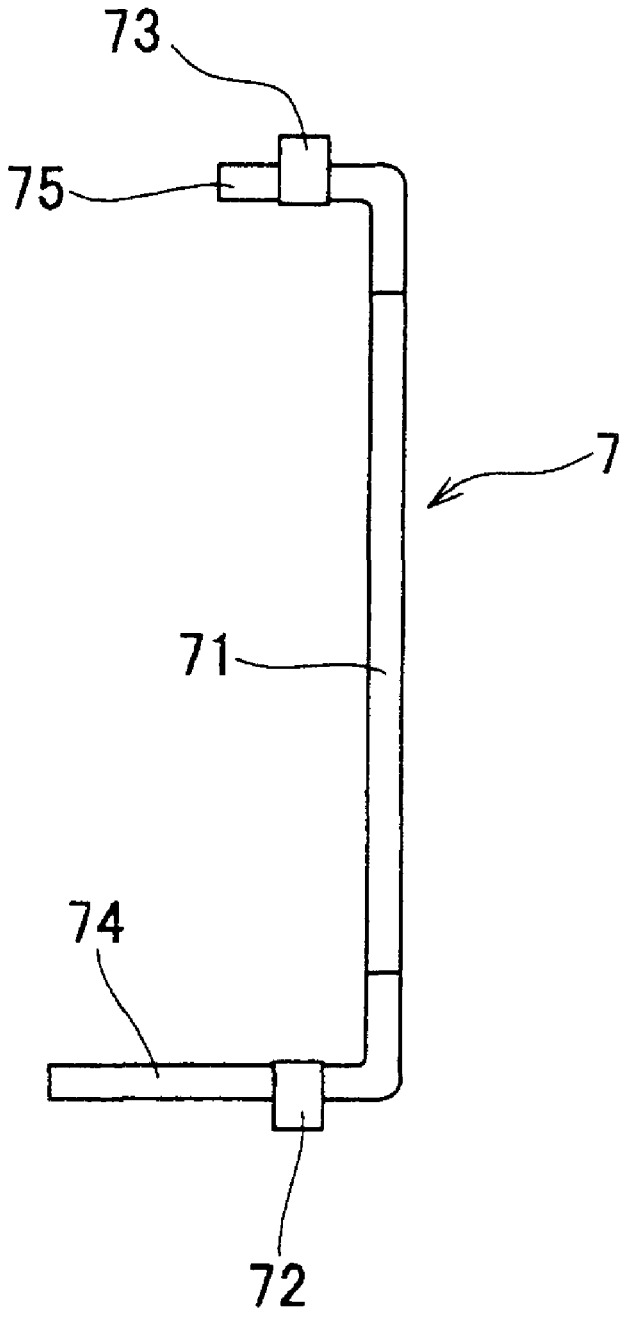
FIG. 11 is a front view of the shield member shown in FIG. 10.
Figure 12:
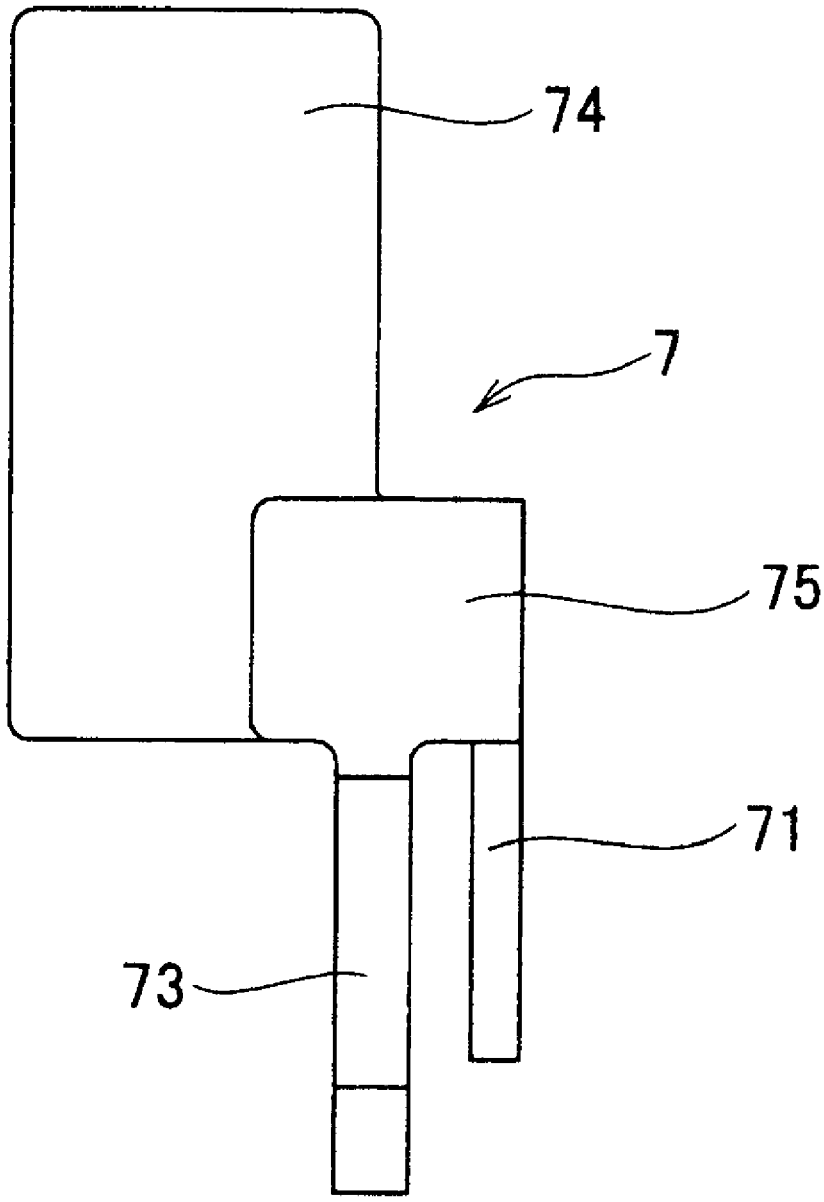
FIG. 12 is a plan view of the shield member shown in FIG. 10.
Figure 13:
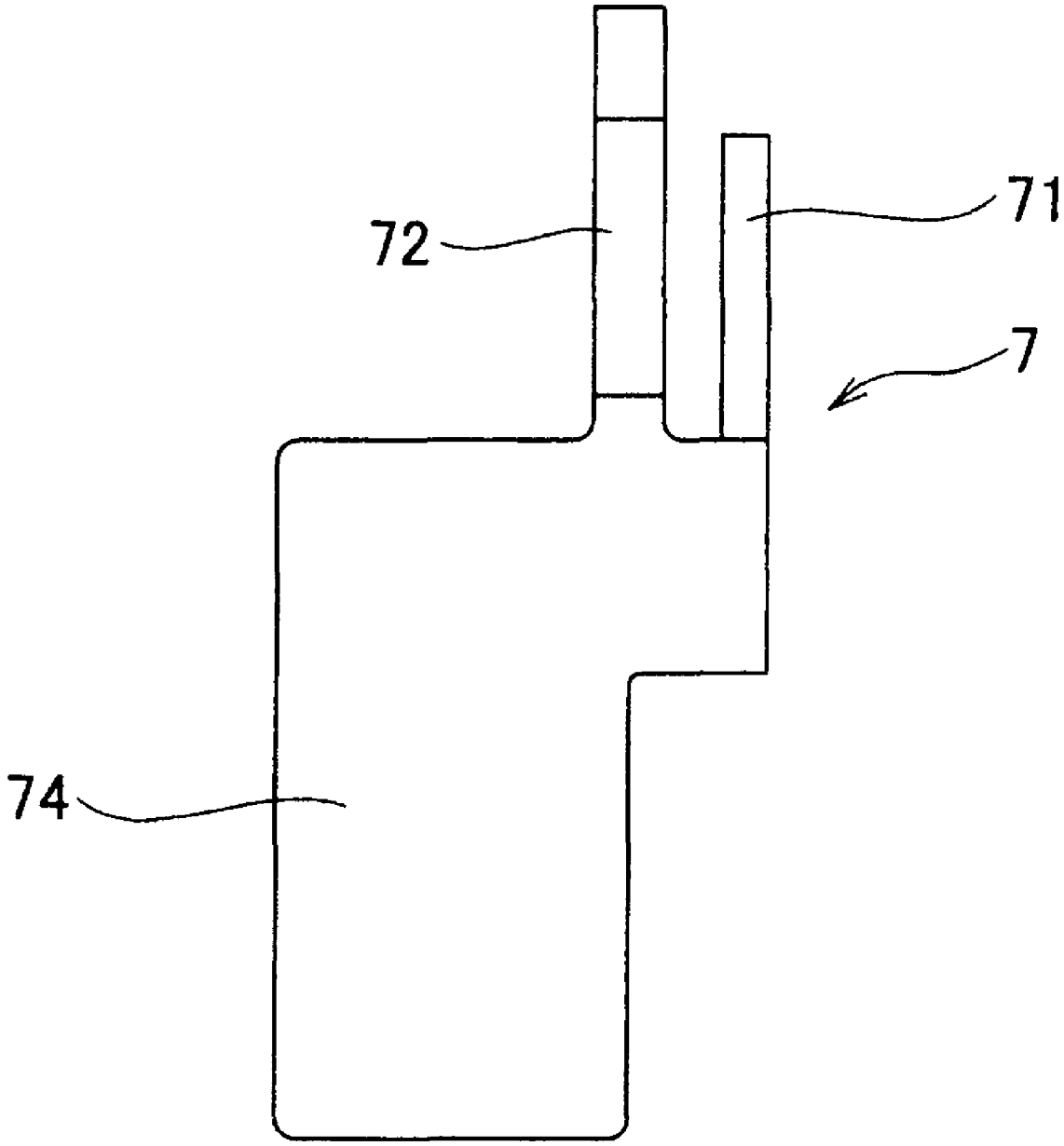
FIG. 13 is a bottom view of the shield member shown in FIG. 10.

Referring to FIGS. 8 and 9, the front housing 32 has an upper surface formed with a recess 321. The front housing 32 has a lower surface formed with a recess 322. A rear surface (see FIG. 9) of the front housing 32 has a central part thereof formed with a groove 323. The groove 323 extends in the height direction H of the front housing 32. As shown in FIG. 8, four contact inserting holes 324 are formed in a left part of the front housing 32 as viewed from the front. The contact inserting holes 324 are opposed to the contact holding holes 315, respectively. Four contact inserting holes 324' are formed in a right part of the front housing 32 as viewed from the front. The contact inserting holes 324' are opposed to the contact holding holes 315', respectively. The front housing 32 has opposite sides thereof formed with locking pieces 325, respectively. The locking pieces 325 each include a locking hole 325*a*. When the rear housing 31 and the front housing 32 are assembled, the protrusions 316 of the rear housing 31 are fitted in the locking holes 325*a* of the locking pieces 325 of the front housing 32, respectively, whereby the protrusions 316 are engaged with the locking pieces 325. As a result, the front housing 32 and the rear housing 31 are coupled to each other.

Figure 18:
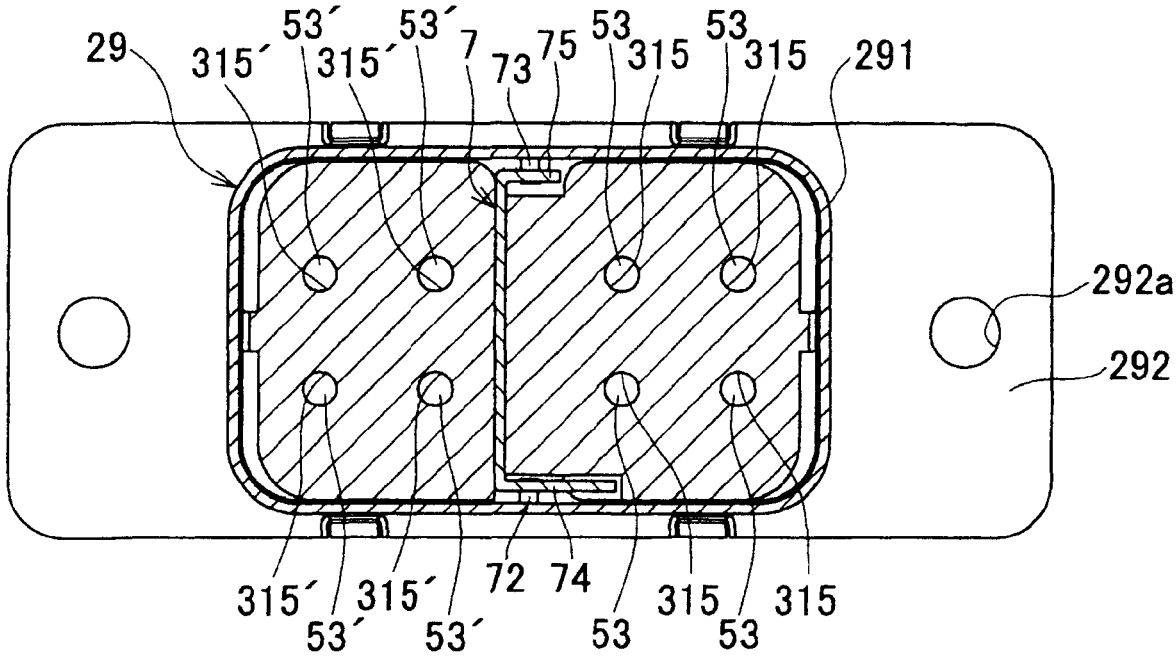
FIG. 18 is a cross-sectional view taken on line XVIII-XVIII in FIG. 17.

As shown in FIGS. 1, 2, 3, and 4, the plurality of contacts 5 each include a contact portion 51, a terminal portion 52, and a link portion 53 (see FIG. 18). The contacts 5 are contacts for high-speed signals. The contact portion 51 has a cylindrical shape, and is inserted in an associated one of the contact inserting holes 324 (see FIG. 9) of the front housing 32. The terminal portion 52 is pin-shaped, and protrudes from the rear housing 31. The link portion 53 links (i.e. connects) the contact portion 51 and the terminal portion 52, and is inserted in and held by an associated one of the contact holding holes 315 (see FIG. 7) of the rear housing 31.

The plurality of contacts 5' each include a contact portion 51', a terminal portion 52', and a link portion 53' (see FIG. 18). The contacts 5' are contacts for power supply. Each contact 5' has the same shape as each contact 5. The contact portion 51' has a cylindrical shape, and is inserted in an associated one of the contact inserting holes 324' (see FIG. 9) of the front housing 32. The terminal portion 52' is pin-shaped, and protrudes from the rear housing 31. The link portion 53' links (i.e. connects) the contact portion 51' and the terminal portion 52', and is inserted in and held by an associated one of the contact holding holes 315' (see FIG. 7) of the rear housing 31.

Referring to FIGS. 10, 11, 12, 13, and 14, the shield member 7 includes a shield plate body 71, first and second spring portions (spring portion) 72 and 73, a ground portion (connection portion) 74, and a plate portion 75. The shield member 7 is formed by blanking and bending a metal plate.

The shield plate body 71 is substantially plate-shaped. A rear portion (left portion of the shield plate body 71 as viewed in FIG. 14) of the shield plate body 71 is inserted in the groove 314 (see FIG. 6) of the rear housing 31, and a front portion (right portion of the shield plate body 71 as viewed in FIG. 14) of the shield plate body 71 is inserted in the groove 323 (see FIG. 9) of the front housing 32.

Figure 14:
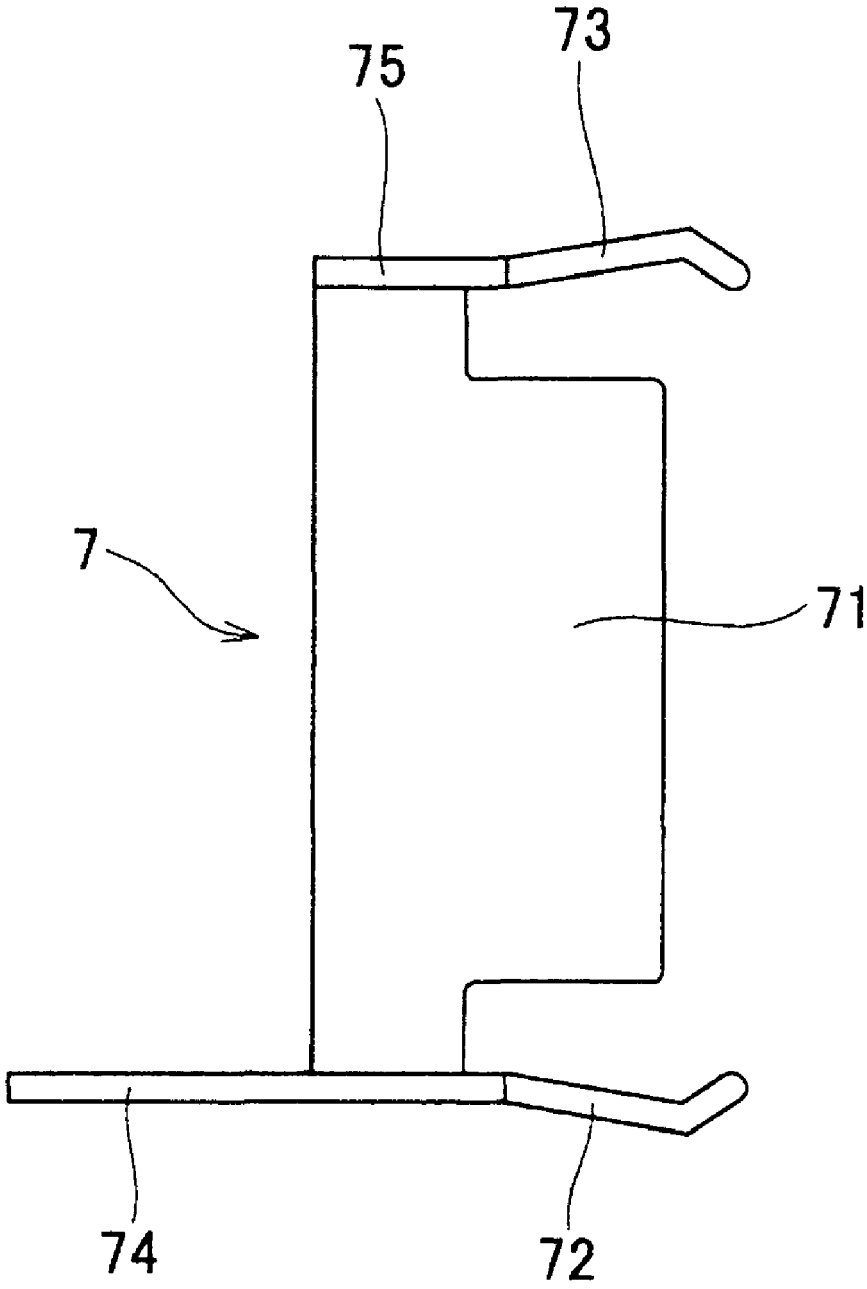
FIG. 14 is a side view of the shield member shown in FIG. 10.

The first spring portion (spring portion) 72 protrudes forward (in the right direction of the shield plate body 71 as viewed in FIG. 14) from the ground portion 74. A front end portion of the first spring portion 72 is bent (see FIGS. 10 and 14). The first spring portion 72 is received in the recess 322 of the front housing 32 (see FIG. 4).

The second spring portion (spring portion) 73 protrudes forward (in the right direction of the shield plate body 71 as viewed in FIG. 14) from the plate portion 75. A front end portion of the second spring portion 73 is bent (see FIGS. 10 and 14). The second spring portion 73 is received in the recess 321 of the front housing 32 (see FIG. 3).

The ground portion 74 is plate-shaped, and is continuous to a lower end of the shield plate body 71. The ground portion 74 is disposed in the recess 313 of the rear housing 31 (see FIG. 4). A cable (not shown) for grounding is connected to the ground portion 74.

The plate portion 75 is continuous to an upper end of the shield plate body 71. The plate portion 75 is disposed in the recess 312 of the rear housing 31 (see FIG. 3).

Figure 15:
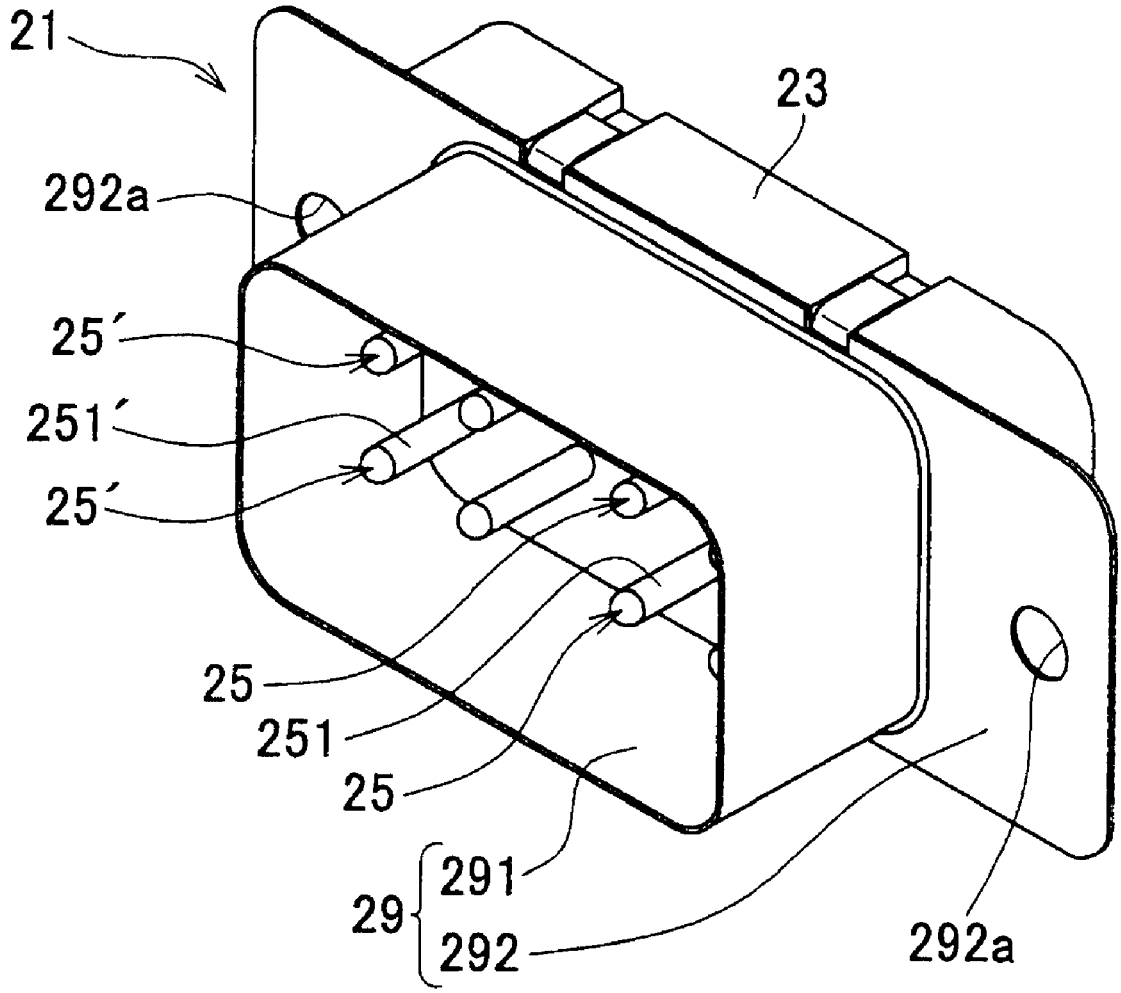
FIG. 15 is a perspective view of a mating connector.
Figure 16:
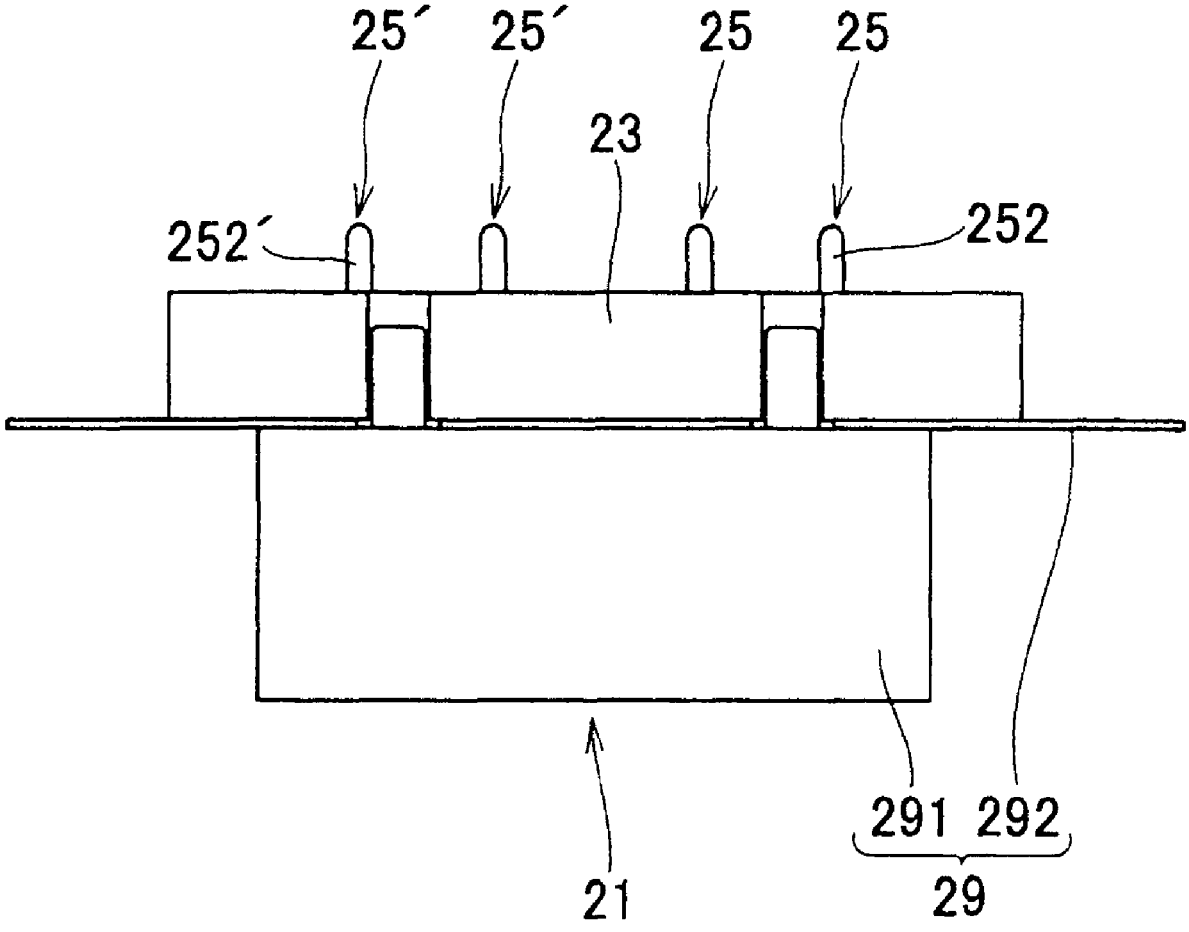
FIG. 16 is a plan view of the mating connector shown in FIG. 15.

Referring to FIGS. 15 and 16, the mating connector 21 is comprised of a mating housing 23, a plurality of mating contacts 25 and 25', and a shell 29.

The mating housing 23 is substantially plate-shaped.

The mating contacts 25, four in number, are disposed on a right part of the mating housing 23 as viewed from the front (as viewed from the fitting side). The four mating contacts 25 each include a contact portion (mating contact portion) 251, a terminal portion 252, and a link portion (not shown). The mating contacts 25 are contacts for high-speed signals. The contact portion 251 is pin-shaped, and protrudes from the front face of the mating housing 23 (see FIG. 15). The terminal portion 252 is pin-shaped, and protrudes from a rear face of the mating housing 23 (see FIG. 16). The link portion links (i.e. connects) the contact portion 251 and the terminal portion 252.

The mating contacts 25', four in number, are disposed on a left part of the mating housing 23 as viewed from the front (as viewed from the fitting side). The four mating contacts 25' each include a contact portion 251', a terminal portion 252', and a link portion (not shown). Each mating contact 25' has the same shape as each mating contact 25. The mating contacts 25' are contacts for power supply. The contact portion 251' is pin-shaped, and protrudes from the front face of the mating housing 23 (see FIG. 15). The terminal portion 252' is pin-shaped, and protrudes from the rear face of the mating housing 23 (see FIG. 16). The link portion links (i.e. connects) the contact portion 251' and the terminal portion 252'.

The shell 29 includes a shell body 291 and a plate portion 292. The shell body 291 is substantially tube-shaped, and surrounds the contact portions 251 and 251' of the plurality of mating contacts 25 and 25'. The plate portion 292 is connected to the shell body 291, and includes a plurality of mounting holes 292*a*.

The shell 29 is mounted on a casing body of an electronic device, not shown, by screws (not shown) inserted through the mounting holes 292*a*. The casing body has electric conductivity, and is electrically connected to the ground.

Figure 17:
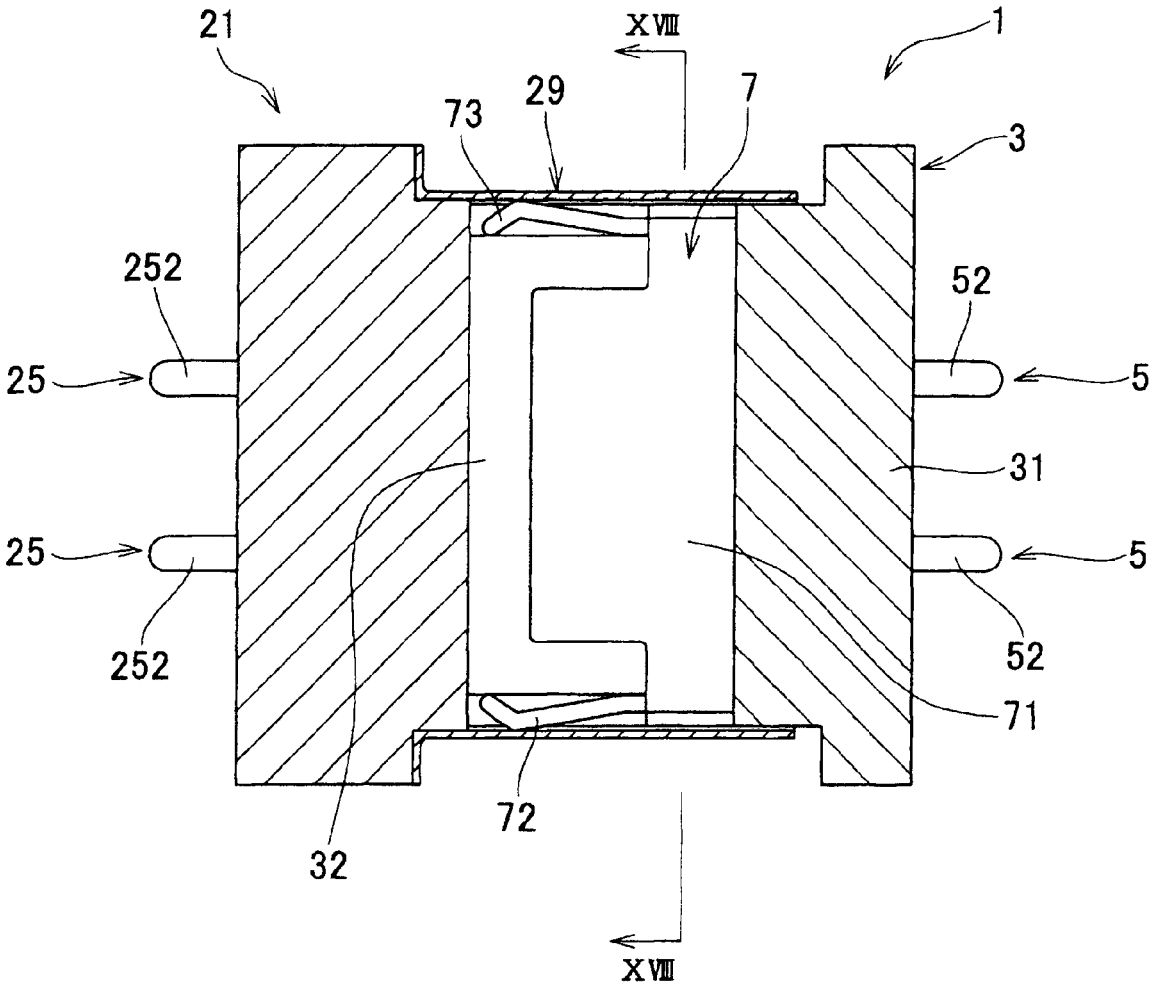
FIG. 17 is a cross-sectional view of a state in which the connector shown in FIG. 1 and the mating connector shown in FIG. 15 are fitted to each other.

Referring to FIGS. 17 and 18, when the mating connector 21 is fitted to the connector 1, the first and second spring portions 72 and 73 of the connector 1 are elastically deformed to be brought into contact with the inner wall surface of the shell 29 of the mating connector 21, respectively, whereby a positive electrically conducted state between the shield member 7 of the connector 1 and the shell 29 of the mating connector 21 is ensured. Further, the shell 29 surrounds the contact portions 51 and 51', and hence the shell 29 of the mating connector 21 also functions as the shell of the connector 1. As a consequence, the contact portions 51 and 51' of the contacts 5 and 5' are electromagnetically shielded by the shell 29.

Further, the contact portions 51 and 51' of the plurality of contacts 5 and 5' are partitioned into a plurality of groups A and B by the shield plate body 71 (see FIG. 19), and the first and second spring portions 72 and 73 formed on the shield plate body 71 are brought into contact with the inner wall surface of the shell 29 of the mating connector 21, to thereby cause the spring force of the first and second spring portions 72 and 73 to act on the inner wall surface of the shell 29, and hence even if the accuracy of the dimensions of the shell 29 of the mating connector 21 and the shield member 7 is not high, it is possible to ensure the stable contact state between the shell 29 and the shield member 7, which makes it possible to use the shell 29 of the mating connector 21 as the shell of the connector 1 itself.

Figure 19:
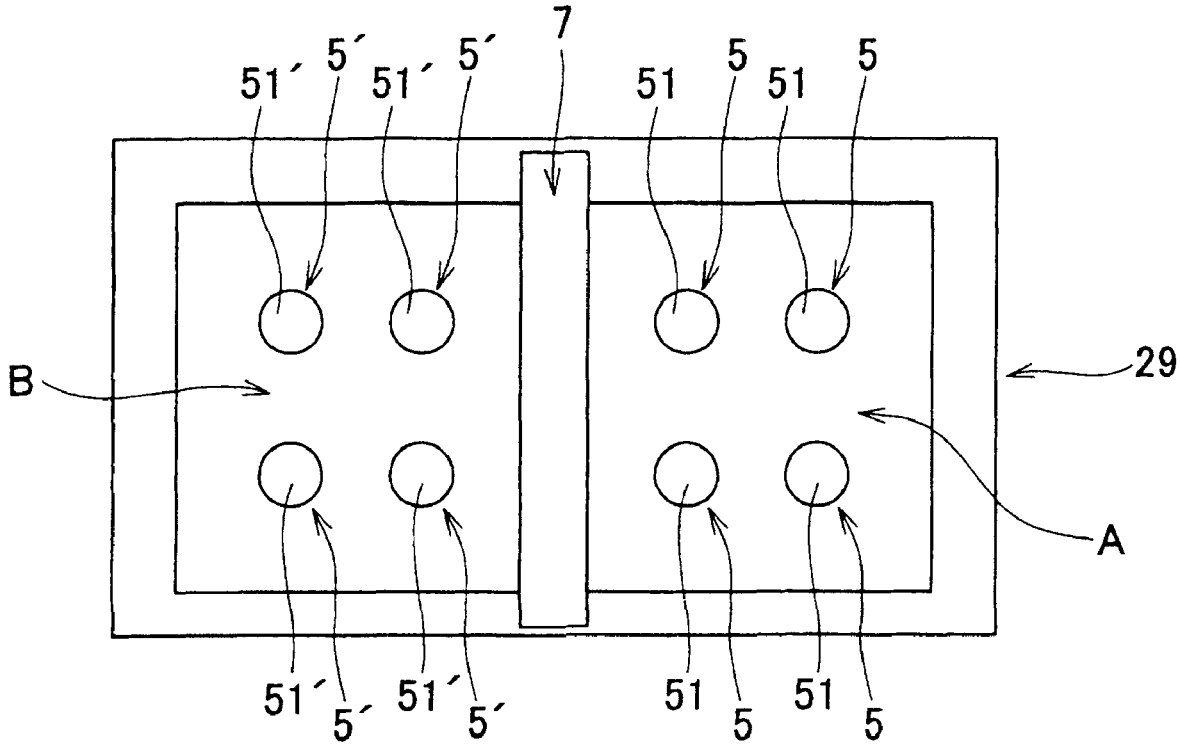
FIG. 19 is a conceptual view of a state in which the plurality of contacts are partitioned into two groups by the shield member.

As shown in FIG. 19, since the contact portions 51 and 51' of the plurality of contacts 5 and 5' are partitioned into two groups by the shield plate body 71 of the shield member 7, the contacts 5 and the contacts 5' are electromagnetically shielded, which prevents the contact portions 51 for high-speed signals from being influenced by the noise from the contact portions 51' for power supply.

According to this embodiment, since it is possible to use the shell 29 of the mating connector 21 as the shell of the connector 1 itself, a shell of the connector 1 itself can be made unnecessary while ensuring the shielding function, and this also makes it possible to easily fit the connector 1 to the mating connector 21. Therefore, differently from the prior art, it is possible to prevent the fitting of the mating connector 21 and the connector 1 from becoming difficult, the breakage of the shell from being caused, due to deformation of the shell.

Figure 20:
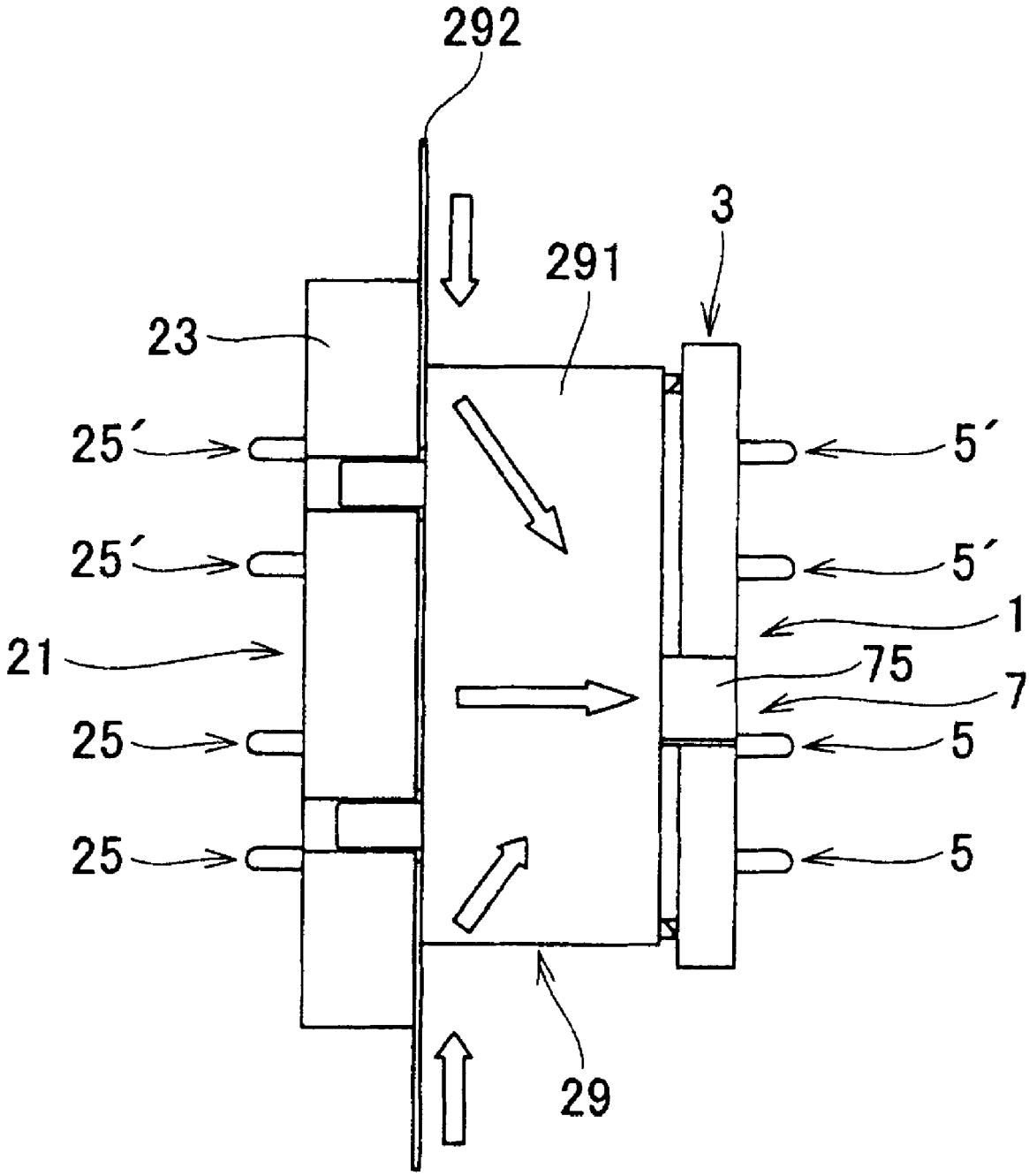
FIG. 20 is a bottom view useful in illustrating how electric current flows when the connector shown in FIG. 1 and the mating connector shown in FIG. 15 are fitted to each other.

Further, since the first and second spring portions 72 and 73 are brought into contact with the respective opposed surfaces of the shell 29 to thereby cause electric current to flow in the whole shield plate body 71, it is possible to obtain higher shielding effectiveness. Referring to FIG. 20, ground current (indicated by a hollow arrow) flows from the plate portion 292 of the shell 29 of the mating connector through the ground portion 74 or the plate portion 75 of the shield member 7.

Further, since the shell of the connector 1 is made unnecessary, and the shell 29 of the mating connector 21 is caused to serve as the shell of the connector 1 as well, it is possible to reduce the size of the connector 1.

It should be noted that although the ground portion 74 is for cable connection, it is not necessarily required to provide the ground portion 74.

Further, it is not necessarily required to provide the plate portion 75.

Although the shield member 7 of this embodiment is formed by blanking and bending a metal plate, the shield member 7 may be formed of a plurality of separate parts.

Further, although in this embodiment, the shield member 7 is one, a plurality of shield members may be employed according to the types, arrangements, and purposes or the like of the contacts. Further, although in this embodiment, the contact portions 51 and 51' of the plurality of contacts 5 and 5' of the connector 1 are partitioned into a plurality of groups in the left and right directions thereof by the shield member 7, the contact portions 51 and 51' may be partitioned into a plurality of groups in the height direction H of the connector 1.

It is further understood by those skilled in the art that the foregoing are the preferred embodiments of the present invention, and that various changes and modification may be made thereto without departing from the spirit and scope thereof.

What is claimed is:

1. A connector that is fitted to a mating connector including a plurality of mating contacts held by a mating housing, and a shell mounted on the mating housing such that the shell surrounds mating contact portions of the plurality of mating contacts, comprising:

a housing;

a plurality of contacts that are held by said housing, and each include a contact portion which is brought into contact with an associated one of the mating contact portions of the plurality of mating contacts; and a shield member that is mounted on said housing, and includes a shield plate body which partitions said contact portions of said plurality of contacts into a plurality of groups, and a spring portion formed on said shield plate body, which is brought into contact with an inner wall surface of the shell.

2. The connector as claimed in claim 1, wherein the inner wall surface of the shell includes two surfaces opposed to each other, and wherein said spring portion comprises a first spring portion which is brought into contact with one of the two surfaces of the inner wall surface of the shell, and a second spring portion which is brought into contact with the other of the two surfaces of the inner wall surface of the shell.

3. A connector as claimed in claim 1, wherein said shield plate body includes a connection portion provided for connection of cables thereto.

4. A connector as claimed in claim 2, wherein said shield plate body includes a connection portion provided for connection of cables thereto.

5. A connector as claimed in claim 3, wherein said shield plate body includes a plate portion formed to be close to one of two opposed surfaces of the inner wall surface, and wherein said connection portion is in the form of a plate which is close to the other of the two surfaces.

6. A connector as claimed in claim 4, wherein said shield plate body includes a plate portion formed to be close to one of the two surfaces, and wherein said connection portion is in the form of a plate which is close to the other of the two surfaces.

7. A connector as claimed in claim 5, wherein said shield plate body, said first spring portion, said second spring portion, said connection portion, and said plate portion are formed by blanking and bending a metal plate.

8. A connector as claimed in claim 6, wherein said shield plate body, said first spring portion, said second spring portion, said connection portion, and said plate portion are formed by blanking and bending a metal plate.

* * * * *